US009663741B2

(12) United States Patent
Tsujimoto et al.

(10) Patent No.: US 9,663,741 B2
(45) Date of Patent: May 30, 2017

(54) LUBRICANT BASE OIL FOR FLUID BEARING

(71) Applicant: NEW JAPAN CHEMICAL CO., LTD., Kyoto-shi, Kyoto (JP)

(72) Inventors: Shinya Tsujimoto, Kyoto (JP); Yasuyuki Kawahara, Kyoto (JP); Hiroshi Ishida, Kyoto (JP)

(73) Assignee: NEW JAPAN CHEMICAL CO., LTD., Kyoto-shi (JP)

( * ) Notice: Subject to any disclaimer, the term of this patent is extended or adjusted under 35 U.S.C. 154(b) by 96 days.

(21) Appl. No.: 14/399,341

(22) PCT Filed: May 24, 2013

(86) PCT No.: PCT/JP2013/064480
§ 371 (c)(1),
(2) Date: Nov. 6, 2014

(87) PCT Pub. No.: WO2013/183463
PCT Pub. Date: Dec. 12, 2013

(65) Prior Publication Data

US 2015/0072911 A1 Mar. 12, 2015

(30) Foreign Application Priority Data

Jun. 7, 2012 (JP) ..... 2012-129637

(51) Int. Cl.
*C07C 69/34* (2006.01)
*C10M 105/38* (2006.01)
*C10M 169/04* (2006.01)

(52) U.S. Cl.
CPC ..... *C10M 105/38* (2013.01); *C10M 169/04* (2013.01); *C10M 2207/022* (2013.01); *C10M 2207/126* (2013.01); *C10M 2207/283* (2013.01); *C10M 2207/2835* (2013.01); *C10M 2207/2895* (2013.01); *C10N 2220/022* (2013.01); *C10N 2220/027* (2013.01); *C10N 2230/02* (2013.01); *C10N 2230/06* (2013.01); *C10N 2230/08* (2013.01); *C10N 2230/10* (2013.01); *C10N 2230/74* (2013.01); *C10N 2240/02* (2013.01)

(58) Field of Classification Search
CPC ..... C10M 105/32; C10M 105/34; C10M 2207/2875
USPC ..... 508/485, 465
See application file for complete search history.

(56) References Cited

U.S. PATENT DOCUMENTS

| | | | | |
|---|---|---|---|---|
| 2005/0282713 | A1 | 12/2005 | Hirata et al. | |
| 2006/0019840 | A1* | 1/2006 | Kawahara | C10M 169/04 508/280 |
| 2009/0290821 | A1 | 11/2009 | Hirata et al. | |
| 2011/0187216 | A1 | 8/2011 | Khan | |

FOREIGN PATENT DOCUMENTS

| | | | |
|---|---|---|---|
| JP | 11-514778 | A | 12/1999 |
| JP | 11-514779 | A | 12/1999 |
| JP | 2000-500898 | A | 1/2000 |
| JP | 2003-119482 | A | 4/2003 |
| JP | 2004-084839 | A | 3/2004 |
| JP | 2005-154726 | A | 6/2005 |
| JP | 2005-290256 | A | 10/2005 |
| JP | 2008-007741 | A | 1/2008 |
| WO | 97/16827 | A1 | 5/1997 |
| WO | 97/16828 | A1 | 5/1997 |
| WO | 97/18562 | A1 | 5/1997 |
| WO | 2004/018595 | A1 | 3/2004 |
| WO | 2011/017629 | A1 | 2/2011 |

OTHER PUBLICATIONS

International Search Report dated Jul. 23, 2013, issued in corresponding application No. PCT/JP2013/064480.

* cited by examiner

*Primary Examiner* — Prem C Singh
*Assistant Examiner* — Francis C Campanell
(74) *Attorney, Agent, or Firm* — Westerman, Hattori, Daniels & Adrian, LLP

(57) ABSTRACT

An object of this invention is to provide a lubricating base oil that has a small rate of change in viscosity (a high viscosity index) over a wide temperature range, low viscosity at low temperatures, and good low-temperature fluidity and evaporation resistance, and that allows reduced decomposition thereof.
To achieve the object, methylpentanediol diesters obtained by using specific aliphatic monocarboxylic acids are used as a lubricating base oil.

7 Claims, No Drawings

LUBRICANT BASE OIL FOR FLUID BEARING

TECHNICAL FIELD

The present invention relates to a lubricating base oil for a fluid bearing.

BACKGROUND ART

Ball bearings and roller bearings have been used as bearings in motors mounted in hard disk drives (HDDs) and the like. However, due to demand for smaller motors, lower vibration/lower noise, etc., fluid dynamic bearings and oil-impregnated sintered bearings, both types of slide bearings, have recently been developed and put into practical use.

A fluid dynamic bearing supports a rotating shaft by the oil film pressure of a lubricating oil present in the gap between the outer circumferential surface of the shaft and the inner circumferential surface of a sleeve. Dynamic pressure grooves are provided in at least one of the outer circumferential surface of the shaft and the inner circumferential surface of the sleeve, and the sliding surface of the rotating shaft is supported in a floating manner by a lubricating oil film formed by the dynamic pressure effect.

Additionally, there is an oil-impregnated sintered bearing in which a porous body made of sintered metal etc. is impregnated with a lubricating oil or a lubricating grease to impart a self-lubricating function, thereby supporting a rotating shaft; there is also a dynamic-pressure-type oil-impregnated sintered bearing, which is an oil-impregnated sintered bearing having dynamic pressure grooves provided in the bearing surface thereof.

Along with the enhanced performance of audiovisual and office automation equipment, increased use of cellular phones, and the like, fluid bearing motors have been put into use. Due to recent strong demand for the speeding up and downsizing of motors, fluid bearings have been required to achieve lower torque. To meet the demand for lower torque, lubricating base oils with relatively low viscosity have been selected. As lubricating base oils with low viscosity, lubricating base oils for fluid bearings, containing a synthetic hydrocarbon-based lubricating base oil such as a poly-α-olefin or containing an ester-based lubricating base oil such as an aliphatic dibasic acid diester, neopentyl-type polyol ester, or fatty acid monoester, have been proposed (Patent Literature 1 to 8).

Among these, many ester-based lubricating base oils, which have excellent viscosity characteristics, heat resistance, low-temperature fluidity, etc., are used as lubricating base oils for fluid bearings.

There are several types of ester-based lubricating base oils having different viscosity characteristics, heat resistance (evaporation resistance), low-temperature fluidity, etc. In addition, the heat resistance (evaporation resistance) of ester-based lubricating base oils tends to become poorer as the viscosity becomes lower. Thus, the mere selection of, in order to reduce the torque of fluid bearings, an ester-based lubricating base oil with a viscosity lower than that of a conventional lubricating base oil leads to impaired heat resistance (evaporation resistance), resulting in reduction in the durability of the fluid bearings.

Additionally, when used as lubricating base oils for fluid bearings, existing ester-based lubricating base oils gradually decompose during operation of fluid bearing motors; therefore, ester-based lubricating base oils are problematic when fluid bearing motors are used for a long period of time.

CITATION LIST

Patent Literature

PTL 1: JPH11-514778A
PTL 2: JPH11-514779A
PTL 3: JP2000-500898A
PTL 4: JP2003-119482A
PTL 5: WO2004/018595
PTL 6: JP2004-084839A
PTL 7: JP2005-290256A
PTL 8: JP2008-007741A

SUMMARY OF INVENTION

Technical Problem

An object of the present invention is to provide a lubricating base oil that has a small rate of change in viscosity (a high viscosity index) over a wide temperature range, low viscosity even at low temperatures, and good low-temperature fluidity and evaporation resistance; and that allows reduced decomposition thereof.

Solution to Problem

The present inventors conducted extensive research to solve the above problems, and found that 3-methyl-1,5-pentanediol diesters obtained by using specific aliphatic monocarboxylic acids is a lubricating base oil that has high viscosity index, low viscosity even at low temperatures, and good low-temperature fluidity and evaporation resistance; and that allows reduced decomposition thereof. Based on this finding, the present inventors accomplished the present invention.

Specifically, the present invention is as follows.

Item 1. A lubricating base oil for a fluid bearing, the lubricating base oil comprising methylpentanediol diesters obtained by an esterification reaction of 3-methyl-1,5-pentanediol with n-undecanoic acid (component A) and at least one aliphatic monocarboxylic acid (component B) selected from the group consisting of n-hexanoic acid, n-heptanoic acid, n-octanoic acid, n-nonanoic acid, and n-decanoic acid, the molar ratio of component A to component B being in the range of 30:70 to 70:30.

Item 2. The lubricating base oil for a fluid bearing according to Item 1, wherein component B is at least one member selected from the group consisting of n-octanoic acid, n-nonanoic acid, and n-decanoic acid.

Item 3. The lubricating base oil for a fluid bearing according to Item 1 or 2, wherein the amount of the methylpentanediol diesters in the lubricating base oil for a fluid bearing is 90 wt % or more.

Item 4. The lubricating base oil for a fluid bearing according to any one of Items 1 to 3, which is a lubricating base oil for a fluid dynamic bearing or a lubricating base oil for an oil-impregnated sintered bearing.

Item 5. The lubricating base oil for a fluid bearing according to any one of Items 1 to 4, which is a lubricating base oil for a fluid bearing for a spindle motor.

Item 6. The lubricating base oil for a fluid bearing according to Item 5, which is a lubricating base oil for a fluid bearing for a spindle motor of a hard disk drive.

Item 7. The lubricating base oil for a fluid bearing according to Item 6, which is a lubricating base oil for a fluid bearing for a spindle motor of a hard disk drive for a server.

Advantageous Effects of Invention

According to the present invention, a lubricating base oil can be obtained that has a small rate of change in viscosity (a high viscosity index) over a wide temperature range, low viscosity even at low temperatures, and good low-temperature fluidity and evaporation resistance; and that allows reduced decomposition thereof.

DESCRIPTION OF EMBODIMENTS

The lubricating base oil of the present invention is a lubricating base oil comprising methylpentanediol diesters prepared from specific aliphatic monocarboxylic acids.

Methylpentanediol Diesters

The methylpentanediol diesters according to the present invention are obtained by an esterification reaction of 3-methyl-1,5-pentanediol with an acid mixture comprising n-undecanoic acid (component A) and at least one aliphatic monocarboxylic acid (component B) selected from the group consisting of n-hexanoic acid, n-heptanoic acid, n-octanoic acid, n-nonanoic acid, and n-decanoic acid, wherein the molar ratio of component A to component B is in the range of 30:70 to 70:30.

Specific examples of the methylpentanediol diesters according to the present invention include diesters prepared from 3-methyl-1,5-pentanediol, and n-undecanoic acid and n-hexanoic acid; diesters prepared from 3-methyl-1,5-pentanediol, and n-undecanoic acid and n-heptanoic acid; diesters prepared from 3-methyl-1,5-pentanediol, and n-undecanoic acid and n-octanoic acid; diesters prepared from 3-methyl-1,5-pentanediol, and n-undecanoic acid and n-nonanoic acid; diesters prepared from 3-methyl-1,5-pentanediol, and n-undecanoic acid and n-decanoic acid; diesters prepared from 3-methyl-1,5-pentanediol, and n-undecanoic acid, n-hexanoic acid, and n-heptanoic acid; diesters prepared from 3-methyl-1,5-pentanediol, and n-undecanoic acid, n-hexanoic acid, and n-octanoic acid; diesters prepared from 3-methyl-1,5-pentanediol, and n-undecanoic acid, n-hexanoic acid, and n-nonanoic acid; diesters prepared from 3-methyl-1,5-pentanediol, and n-undecanoic acid, n-hexanoic acid, and n-decanoic acid; diesters prepared from 3-methyl-1,5-pentanediol, and n-undecanoic acid, n-heptanoic acid, and n-octanoic acid; diesters prepared from 3-methyl-1,5-pentanediol, and n-undecanoic acid, n-heptanoic acid, and n-nonanoic acid; diesters prepared from 3-methyl-1,5-pentanediol, and n-undecanoic acid, n-heptanoic acid, and n-decanoic acid; diesters prepared from 3-methyl-1,5-pentanediol, and n-undecanoic acid, n-octanoic acid, and n-nonanoic acid; diesters prepared from 3-methyl-1,5-pentanediol, and n-undecanoic acid, n-octanoic acid, and n-decanoic acid; diesters prepared from 3-methyl-1,5-pentanediol, and n-undecanoic acid, n-nonanoic acid, and n-decanoic acid; and the like.

Esterification Reaction

The methylpentanediol diesters of the present invention are produced by an esterification reaction of 3-methyl-1,5-pentanediol with the aliphatic monocarboxylic acids. There is no particular limitation on the production method, and a hitherto known production method can be used.

The methylpentanediol diesters according to the present invention can be obtained, for example, by an esterification reaction of 3-methyl-1,5-pentanediol with the aliphatic monocarboxylic acids in the presence of an esterification catalyst, followed by after-treatment and/or purification treatment.

In the esterification reaction, the aliphatic monocarboxylic acids are used in an amount of typically 2.0 to 3.0 moles, and preferably 2.02 to 2.5 moles, per mole of 3-methyl-1,5-pentanediol.

Examples of esterification catalysts include Lewis acids, sulfonic acid derivatives, and the like. Specific examples of Lewis acids include aluminum derivatives, tin derivatives, and titanium derivatives. Examples of sulfonic acid derivatives include p-toluenesulfonic acid, methanesulfonic acid, sulfuric acid, and the like. The amount to be used is, for example, typically about 0.01 to about 5.0 wt % based on the total weight of 3-methyl-1,5-pentanediol and the aliphatic monocarboxylic acids.

It is preferred that the esterification reaction be carried out at a reaction temperature of typically 120 to 250° C., and preferably 140 to 230° C. in the presence of an inert gas. The reaction time is typically about 3 to about 30 hours. If necessary, the water produced may be discharged from the system by an azeotropic distillation using a water-entraining agent such as benzene, toluene, xylene, or cyclohexane.

After completion of the esterification reaction, excess starting materials are evaporated under reduced pressure or atmospheric pressure. Subsequently, the resultant methylpentanediol diesters may be purified using a conventional purification method such as, for example, neutralization, washing with water, liquid-liquid extraction, distillation under reduced pressure, or purification with an adsorbent such as activated carbon.

It is recommendable that the lubricating base oil for a fluid bearing of the present invention have a kinematic viscosity in the range of typically 1 to 20 $mm^2/s$, more preferably 5 to 15 $mm^2/s$, and particularly 7 to 13 $mm^2/s$, at 40° C. These kinematic viscosity values are those obtained by the method described in the Examples below.

It is recommendable that the lubricating base oil for a fluid bearing of the present invention have a viscosity index of typically 120 or more, more preferably 130 or more, and particularly 150 or more. These viscosity index values are those obtained by the method described in the Examples below.

The low-temperature fluidity of the lubricating base oil for a fluid bearing of the present invention can be evaluated, for example, by measuring the pour point in a test for low-temperature fluidity. It is recommendable that the pour point be typically 0° C. or lower, and more preferably −15° C. or lower. These pour point values are those obtained by the method described in the Examples below.

The heat resistance of the lubricating base oil for a fluid bearing of the present invention can be evaluated, for example, by measuring the evaporation amount in a test for heat resistance. It is recommendable that the evaporation amount be typically 5 wt % or less, more preferably 4 wt % or less, and particularly 2 wt % or less. These evaporation amount values are those obtained by the method described in the Examples below.

The lubricating ability of the lubricating base oil for a fluid bearing of the present invention can be evaluated, for example, by measuring the wear scar diameter in a test for lubricating ability. It is recommendable that the wear scar diameter be preferably 0.60 mm or less, more preferably 0.58 mm or less, and particularly preferably 0.55 mm or less. The smaller the wear scar diameter, the better the lubricating ability. These wear scar diameter values are those obtained in a test for lubricating ability described in the Examples below.

The stability of the lubricating base oil for a fluid bearing of the present invention at the time of use can be evaluated, for example, by measuring the increase amount of partial esters (compound formed by hydrolysis of one of the ester groups of diester compound) after the above-mentioned test for lubricating ability. It is recommendable that the increase amount of partial esters after the test for the lubricating oil be preferably 0.10 GC area % or less, more preferably 0.08 GC area % or less, and particularly preferably 0.06 GC area % or less. The smaller the increase amount of partial esters, the better the stability of the lubricating base oil. These increase amount values of partial esters are those obtained in the measurement of partial ester increase amount described in the Examples below.

The stability of the lubricating base oil for a fluid bearing of the present invention at the time of use can also be evaluated by measuring the increase amount of the total acid number after the test for lubricating ability. It is recommendable that the increase amount of the total acid number after the test for lubricating ability be preferably 0.60 mg KOH/g or less, more preferably 0.55 mg KOH/g or less, and particularly preferably 0.50 mg KOH/g or less. The smaller the increase amount of the total acid number, the better the stability of the lubricating base oil. These increase amount values of the total acid number are those obtained by the measurement of the increase amount of the total acid number described in the Examples below.

The methylpentanediol diesters are present in an amount of preferably 90 wt % or more, more preferably 95 wt % or more, and particularly preferably 98 wt % or more of the lubricating base oil for a fluid bearing of the present invention.

The lubricating base oil for a fluid bearing of the present invention may suitably additionally contain at least one additional base oil. Examples of additional base oils include mineral oils (hydrocarbon oils obtained by purification of petroleum), poly-α-olefins, polybutenes, alkylbenzenes, alkylnaphthalenes, alicyclic hydrocarbon oils, isomerized oils of synthetic hydrocarbons obtained by the Fischer-Tropsch process and like synthetic hydrocarbon oils, animal and vegetable oils, organic acid esters other than the present ester, polyalkylene glycols, polyvinyl ethers, polyphenyl ethers, alkylphenyl ethers, silicone oils, and the like.

Examples of mineral oils include solvent-refined mineral oils, mineral oils treated by hydrogenation, and wax isomerized oils, and usable mineral oils are those having a kinematic viscosity in the range of typically 1.0 to 25 $mm^2/s$, and preferably 2.0 to 20.0 $mm^2/s$, at 100° C.

Examples of poly-α-olefins include polymers or copolymers of α-olefins having 2 to 16 carbon atoms (for example, ethylene, propylene, 1-butene, 1-hexene, 1-octene, 1-decene, 1-dodecene, 1-tetradecene, 1-hexadecene, etc.), the polymers or copolymers having a kinematic viscosity of 1.0 to 25 $mm^2/s$ at 100° C. and a viscosity index of 100 or more, and particularly preferably a kinematic viscosity of 1.5 to 20.0 $mm^2/s$ at 100° C. and a viscosity index of 120 or more.

Examples of polybutenes include those obtained by polymerizing isobutylene, or obtained by copolymerizing isobutylene with normal butylene, and those having a kinematic viscosity in the wide range of 2.0 to 40 $mm^2/s$ at 100° C. are generally usable.

Examples of alkylbenzenes include monoalkylbenzenes, dialkylbenzenes, trialkylbenzenes, tetraalkylbenzenes, and the like, with a molecular weight of 200 to 450, the alkyl(s) being linear or branched and having 1 to 40 carbon atoms.

Examples of alkylnaphthalenes include monoalkylnaphthalenes, dialkylnaphthalenes, and the like, the alkyl(s) being linear or branched and having 1 to 30 carbon atoms.

Examples of animal and vegetable oils include beef tallow, lard, palm oil, coconut oil, rapeseed oil, castor oil, sunflower oil, and the like.

Examples of organic acid esters, other than the present ester, include fatty acid monoesters, aliphatic dibasic acid diesters, polyol esters, and other esters.

Examples of fatty acid monoesters include esters of a $C_5$-$C_{22}$ aliphatic linear or branched monocarboxylic acid and a $C_3$-$C_{22}$ linear or branched saturated or unsaturated aliphatic alcohol.

Examples of aliphatic dibasic acid diesters include esters of a $C_3$-$C_{22}$ linear or branched saturated or unsaturated aliphatic alcohol with an aliphatic dibasic acid such as oxalic acid, malonic acid, succinic acid, glutaric acid, adipic acid, pimelic acid, suberic acid, azelaic acid, sebacic acid, 1,9-nonamethylenedicarboxylic acid, 1,10-decamethylenedicarboxylic acid, etc., or an anhydride thereof.

For polyol esters, it is possible to use esters of a polyol that has a neopentyl structure or a polyol that has a non-neopentyl structure with a $C_3$-$C_{22}$ linear or branched saturated or unsaturated monocarboxylic acid. Examples of polyols that have a neopentyl structure include neopentyl glycol, 2,2-diethylpropanediol, 2-butyl-2-ethylpropanediol, trimethylolethane, trimethylolpropane, pentaerythritol, ditrimethylolpropane, dipentaerythritol, and the like. Examples of polyols that has a non-neopentyl structure include 1,3-propanediol, 1,4-butanediol, 1,5-pentanediol, 1,6-hexanediol, 1,7-heptanediol, 1,8-octanediol, 1,9-nonanediol, 1,10-decanediol, 1,2-propanediol, 2-methyl-1,3-propanediol, 1,3-butanediol, 2-methyl-1,4-butanediol, 1,4-pentanediol, 2-methyl-1,5-pentanediol, 1,5-hexanediol, 2-methyl-1,6-hexanediol, 3-methyl-1,6-hexanediol, 1,6-heptanediol, 2-methyl-1,7-heptanediol, 3-methyl-1,7-heptanediol, 4-methyl-1,7-heptanediol, 1,7-octanediol, 2-methyl-1,8-octanediol, 3-methyl-1,8-octanediol, 4-methyl-1,8-octanediol, 1,8-nonanediol, 2-methyl-1,9-nonanediol, 3-methyl-1,9-nonanediol, 4-methyl-1,9-nonanediol, 5-methyl-1,9-nonanediol, 2-ethyl-1,3-hexanediol, 2,4-diethyl-1,5-pentanediol, glycerin, polyglycerol, sorbitol, and the like.

Examples of other esters include esters of a polymerized fatty acid such as dimer acid or hydrogenated dimer acid, or a hydroxy fatty acid such as a condensed castor oil fatty acid or a hydrogenated condensed castor oil fatty acid, with a $C_3$-$C_{22}$ linear or branched saturated or unsaturated aliphatic alcohol.

Examples of polyalkylene glycols include a polymer prepared from an alcohol and one or more $C_2$-$C_4$ linear or branched alkylene oxides by ring-opening polymerization. Examples of alkylene oxides include ethylene oxide, propylene oxide, and butylene oxide; it is possible to use polymers prepared from one of these, or copolymers prepared from a mixture of two or more of these. It is also possible to use such compounds wherein the hydroxy group(s) at one or both ends are etherified. The kinematic viscosity of the polymer is 5.0 to 1000 $mm^2/s$ (40° C.), and preferably 5.0 to 500 $mm^2/s$ (40° C.).

Polyvinyl ethers are compounds obtained by polymerizing a vinyl ether monomer. Examples of monomers include methyl vinyl ether, ethyl vinyl ether, isopropyl vinyl ether, n-butyl vinyl ether, isobutyl vinyl ether, sec-butyl vinyl ether, tert-butyl vinyl ether, n-pentyl vinyl ether, n-hexyl vinyl ether, 2-methoxyethyl vinyl ether, 2-ethoxyethyl vinyl ether, and the like. The kinematic viscosity of the polymer is 5.0 to 1000 $mm^2/s$ (40° C.), and preferably 5.0 to 500 $mm^2/s$ (40° C.).

Examples of polyphenyl ethers include compounds having a structure wherein the meta positions of two or more aromatic rings are connected by ether linkages or thioether linkages, specifically, for example, bis(m-phenoxyphenyl) ether, m-bis(m-phenoxyphenoxy)benzene, and thioethers (so-called C-ethers) wherein one or more oxygen atoms thereof are replaced by one or more sulfur atoms.

Examples of alkylphenyl ethers include compounds wherein a polyphenyl ether is substituted with $C_6$-$C_{18}$ linear or branched alkyl group(s); in particular, alkyldiphenyl ethers substituted with one or more alkyl groups are preferable.

Examples of silicone oils include dimethyl silicone and methylphenyl silicone, and also include long-chain alkyl silicone, fluorosilicone, and like modified silicones.

The content of the at least one additional base oil in the lubricating base oil for a fluid bearing of the present invention is recommendably less than 10 wt %, preferably less than 5 wt %, and particularly preferably less than 2 wt %.

The lubricating base oil for a fluid bearing of the present invention may contain at least one additive in addition to a lubricating base oil (i.e., methylpentanediol diesters or methylpentanediol diesters plus the at least one additional base oil), to improve the performance of the oil. Examples of additives include antioxidants, metal detergents, ashless dispersants, oiliness agents, antiwear agents, extreme-pressure agents, metal deactivators, rust inhibitors, viscosity index improvers, pour point depressants, antifoaming agents, hydrolysis inhibitors, and the like. The amounts of such additives are not particularly limited as long as the effects of the present invention are achieved, and specific examples are as described below.

Examples of antioxidants include 2,6-di-tert-butylphenol, 2,6-di-tert-butyl-cresol, 4,4'-methylenebis(2,6-di-tert-butylphenol), 4,4'-butylidenebis(3-methyl-6-tert-butylphenol), 2,2'-methylenebis(4-ethyl-6-tert-butylphenol), 2,2'-methylenebis(4-methyl-6-tert-butylphenol), 4,4'-isopropylidenebisphenol, 2,4-dimethyl-6-tert-butylphenol, tetrakis[methylene-3-(3,5-di-tert-butyl-4-hydroxyphenyl)propionate] methane, 1,1,3-tris(2-methyl-4-hydroxy-5-tert-butylphenyl) butane, 1,3,5-trimethyl-2,4,6-tris(3,5-di-tert-butyl-4-hydroxybenzyl)benzene, 2,2'-dihydroxy-3,3'-di(α-methylcyclohexyl)-5,5'-dimethyl-diphenylmethane, 2,2'-isobutylidenebis(4,6-dimethylphenol), 2,6-bis(2'-hydroxy-3'-tert-butyl-5'-methylbenzyl)-4-methylphenol, 1,1'-bis(4-hydroxyphenyl)cyclohexane, 2,5-di-tert-amylhydroquinone, 2,5-di-tert-butylhydroquinone, 1,4-dihydroxyanthraquinone, 3-tert-butyl-4-hydroxyanisole, 2-tert-butyl-4-hydroxyanisole, 2,4-dibenzoylresorcinol, 4-tert-butylcatechol, 2,6-di-tert-butyl-4-ethylphenol, 2-hydroxy-4-methoxybenzophenone, 2,4-dihydroxybenzophenone, 2,2'-dihydroxy-4-methoxybenzophenone, 2,4,5-trihydroxybenzophenone, α-tocopherol, bis[2-(2-hydroxy-5-methyl-3-tert-butylbenzyl)-4-methyl-6-tert-butylphenyl]terephthalate, triethyleneglycol bis[3-(3-tert-butyl-5-methyl-4-hydroxyphenyl) propionate], 1,6-hexanediol-bis[3-(3,5-di-tert-butyl-4-hydroxyphenyl)propionate]; diphenylamines such as diphenylamine, monobutyl (including linear and branched) diphenylamines, monopentyl (including linear and branched) diphenylamines, monohexyl (including linear and branched) diphenylamines, monoheptyl (including linear and branched) diphenylamines, monooctyl (including linear and branched) diphenylamines, and like monoalkyl diphenylamines, in particular, mono($C_4$-$C_9$ alkyl)diphenylamines (i.e., diphenylamines wherein one of the two benzene rings is mono-substituted with an alkyl group, in particular, a $C_4$-$C_9$ alkyl group, i.e., a monoalkyl-substituted diphenylamines), p,p'-dibutyl (including linear and branched) diphenylamines, p,p'-dipentyl (including linear and branched) diphenylamines, p,p'-dihexyl (including linear and branched) diphenylamines, p,p'-diheptyl (including linear and branched) diphenylamines, p,p'-dioctyl (including linear and branched) diphenylamines, p,p'-dinonyl (including linear and branched) diphenylamines, and like di(alkylphenyl)amines, in particular, p,p'-di($C_4$-$C_9$alkylphenyl) amines (i.e., dialkyl-substituted diphenylamines wherein each of the two benzene rings is mono-substituted with an alkyl group, in particular, a $C_4$-$C_9$ alkyl group, and the two alkyl groups are identical), di(mono $C_4$-$C_9$ alkylphenyl) amines wherein the alkyl group on one of the benzene rings is different from the alkyl group on the other of the benzene rings, di(di-$C_4$-$C_9$ alkylphenyl)amines wherein at least one of the four alkyl groups on the two benzene rings is different from the rest of the alkyl groups; naphthylamines such as N-phenyl-1-naphthylamine, N-phenyl-2-naphthylamine, 4-octylphenyl-1-naphthylamine, and 4-octylphenyl-2-naphthylamine; phenylenediamines such as p-phenylenediamine, N-phenyl-N'-isopropyl-phenylenediamine, and N-phenyl-N'-(1,3-dimethylbutyl)-p-phenylenediamine; and the like. Among these, in particular, p,p'-dioctyl (including linear and branched) diphenylamines, p,p'-dinonyl (including linear and branched) diphenylamines, N-phenyl-1-naphthylamine, di(n-dodecyl)thiodipropionate, di(n-octadecyl)thiodipropionate and like thiodipropionic acid esters, phenothiazine and like sulfur-based compounds, etc., can be given as preferable examples. These antioxidants may be used singly, or in combination. When such antioxidants are used, the amount thereof is typically 0.01 to 5 wt %, and preferably 0.05 to 3 wt %, based on the lubricating base oil.

Here, "0.01 to 5 wt %, based on the lubricating base oil" means 0.01 to 5 parts by weight per 100 parts by weight of the lubricating base oil consisting of the methylpentanediol diesters according to the present invention, or the lubricating base oil comprising a mixture of the methylpentanediol diesters and the at least one additional base oil according to the present invention. The same applies to similar expressions described hereafter.

Examples of usable metal detergents include Ca-petroleum sulfonates, overbased Ca-petroleum sulfonates, Ca-alkylbenzene sulfonates, overbased Ca-alkylbenzene sulfonates, Ba-alkylbenzene sulfonates, overbased Ba-alkylbenzene sulfonates, Mg-alkylbenzene sulfonates, overbased Mg-alkylbenzene sulfonates, Na-alkylbenzene sulfonates, overbased Na-alkylbenzene sulfonates, Ca-alkylnaphthalene sulfonates, overbased Ca-alkylnaphthalene sulfonates, and like metal sulfonates; Ca-phenate, overbased Ca-phenate, Ba-phenate, overbased Ba-phenate, and like metal phenates; Ca-salicylate, overbased Ca-salicylate and like metal salicylates; Ca-phosphonate, overbased Ca-phosphonate, Ba-phosphonate, overbased Ba-phosphonate, and like metal phosphonates; overbased Ca-carboxylates; and the like. When such metal detergents are used, the amount thereof in the lubricant oil composition is typically about 1 to about 10 wt %, and preferably about 2 to about 7 wt %.

Examples of ashless dispersants include polyalkenyl succinimides, polyalkenyl succinamides, polyalkenyl benzylamines, polyalkenyl succinic acid esters, and the like. These ashless dispersants can be used singly, or in combination. When such ashless dispersants are used, the amount thereof is typically 1 to 10 wt %, and preferably 2 to 7 wt %, based on the lubricating base oil.

Examples of oiliness agents include stearic acid, oleic acid and like saturated or unsaturated aliphatic monocarboxylic acids; dimer acid, hydrogenated dimer acid, and like polymerized fatty acids; ricinoleic acid, 12-hydroxystearic acid, and like hydroxyfatty acids; lauryl alcohol, oleyl alcohol, and like saturated or unsaturated aliphatic monoalcohols; stearyl amine, oleyl amine, and like saturated or unsaturated aliphatic monoamines; lauramide, oleamide, and like saturated or unsaturated aliphatic monocarboxylic acid amides; batyl alcohol, chimyl alcohol, selachyl alcohol, and like glycerin ethers; lauryl polyglycerol ether, oleyl polyglyceryl ether, and like alkyl or alkenyl polyglyceryl ethers; di(2-ethylhexyl)monoethanolamine, diisotridecyl monoethanolamine, and like poly(alkylene oxide) adducts of alkyl or alkenylamine; and the like. These oiliness agents can be used singly, or in combination. When such oiliness agents are used, the amount thereof is typically 0.01 wt % to 5 wt %, and preferably 0.1 wt % to 3 wt %, based on the lubricating base oil.

Examples of antiwear agents and extreme-pressure agents include phosphorus-based compounds such as tricresyl phosphate, cresyldiphenyl phosphate, alkylphenyl phosphates, tributyl phosphate, dibutyl phosphate and like phosphoric acid esters, tributyl phosphite, dibutyl phosphite, triisopropyl phosphite and like phosphorus acid esters, as well as amine salts thereof; sulfur-based compounds such as sulfurized oils and fats, sulfurized oleic acid and like sulfurized fatty acids, di-benzyl disulfide, sulfurized olefins, and dialkyl disulfides; organometallic compounds such as Zn-dialkyldithio phosphates, Mo-dialkyldithio phosphates, and Mo-dialkyldithio carbamates; and the like. These antiwear agents can be used singly, or in combination. When such antiwear agents are used, the amount thereof is typically 0.01 to 10 wt %, and preferably 0.1 to 5 wt %, based on the lubricating base oil.

Examples of metal deactivators include benzotriazole-based compounds, thiadiazole-based compounds, gallic acid ester-based compounds, and the like. These metal deactivators can be used singly, or in combination. When such metal deactivators are used, the amount thereof is typically 0.01 to 0.4 wt %, and preferably 0.01 to 0.2 wt %, based on the lubricating base oil.

Examples of rust inhibitors include dodecenylsuccinic acid half esters, octadecenylsuccinic anhydride, dodecenylsuccinic acid amide, and like alkyl or alkenyl succinic acid derivatives; sorbitan monooleate, glycerol monooleate, pentaerythritol monooleate, and like partial esters of polyhydric alcohols; Ca-petroleum sulfonate, Ca-alkylbenzene sulfonates, Ba-alkylbenzene sulfonates, Mg-alkylbenzene sulfonates, Na-alkylbenzene sulfonates, Zn-alkylbenzene sulfonates, Ca-alkylnaphthalene sulfonates, and like metal sulfonates; rosin amine, N-oleyl sarcosine, and like amines; dialkyl phosphite amine salts; and the like. These rust inhibitors can be used singly, or in combination. When such rust inhibitors are used, the amount thereof is typically 0.01 to 5 wt %, and preferably 0.05 to 2 wt %, based on the lubricating base oil.

Examples of viscosity index improvers include polyalkylmethacrylates, polyalkylstyrenes, polybutenes, ethylene-propylene copolymers, styrene-diene copolymers, styrene-maleic anhydride ester copolymers, and like olefin copolymers. These viscosity index improvers can be used singly, or in combination. When such viscosity index improvers are used, the amount thereof is typically 0.1 to 15 wt %, and preferably 0.5 to 7 wt %, based on the lubricating base oil.

Examples of pour point depressants include condensates of chlorinated paraffin and alkylnaphthalene, condensates of chlorinated paraffin and phenol, and polyalkylmethacrylates, polyalkylstyrenes, polybutenes, etc., which are also viscosity index improvers as mentioned above. These pour point depressants can be used singly, or in combination. When such pour point depressants are used, the amount thereof is typically 0.01 to 5 wt %, and preferably 0.1 to 3 wt %, based on the lubricating base oil.

Liquid silicones are suitable as an antifoaming agent. When such antifoaming agents are used, the amount thereof is typically 0.0005 to 0.01 wt %, based on the lubricating base oil.

Examples of usable hydrolysis inhibitors include alkyl glycidyl ethers, alkyl glycidyl esters, alkylene glycol glycidyl ethers, alicyclic epoxides, phenyl glycidyl ether and like epoxy compounds, and di-tert-butylcarbodiimide, tolylcarbodiimide, and like carbodiimide compounds; and the amount is typically 0.05 to 2 wt %, based on the lubricating base oil.

The lubricating base oil for a fluid bearing of the present invention has little decomposition even after the test for lubricating ability, and has a small evaporation amount. Thus, the lubricating base oil for a fluid bearing of the present invention can be suitably used, in particular, as a lubricating base oil for a fluid bearing for a spindle motor. In particular, the lubricating base oil for a fluid bearing of the present invention is suitable as a lubricating base oil for a fluid bearing for a spindle motor of a hard disk drive, in particular, for a spindle motor of a hard disk drive for a server.

EXAMPLES

The present invention will be described below in detail with reference to Examples; however, the present invention is not limited to these Examples. The physical properties and chemical properties of the lubricating base oil in each Example were evaluated by the following methods.

(a) Total Acid Number

The total acid number was measured according to JIS-K-2501 (1992). The detection limit is 0.01 mg KOH/g.

(b) Kinematic Viscosity

The kinematic viscosity at 40° C. and 100° C. was measured according to JIS-K-2283 (2000). The kinematic viscosity at 0° C. was calculated by using a relational expression of viscosity and temperature prescribed in JIS-K-2283 (2000).

(c) Viscosity Index

The viscosity index was calculated according to JIS-K-2283 (2000).

(d) Test for Low-Temperature Fluidity (Pour Point)

The pour point was measured according to JIS-K-2269 (1987).

(e) Test for Heat Resistance (Evaporation Amount)

To the lubricating base oil of each Example and each Comparative Example, 0.5 wt % 2,2'-methylenebis-2,6-di-tert-butylphenol (produced by Tokyo Chemical Industry Co., Ltd.) and 0.5 wt % IRGANOX L57 (product name, produced by BASF) were added and dissolved to prepare individual lubricating oil compositions. In individual glass tubes having an inside diameter of 25 mm and a height of 90 mm was placed 10 g of each lubricating oil composition. Each glass tube was capped with a silicone rubber stopper equipped with two glass tubes, and air was supplied from one of the two glass tubes at 1.0 NL/min. Each glass tube was immersed in an oil bath set at 150° C., and heated for 20 hours. The evaporation amount after the heating test was calculated according to the following formula.

$$\text{Evaporation amount (\%)}=[(W_0-W)/W_0]\times 100$$

In the formula, $W_0$ represents the weight before the test, and W represents the weight after the test.

(f) Test for Lubricating Ability

A test was performed according to JPI-5S-32-90 with a high-speed four-ball friction tester (produced by Shinko Engineering Co. Ltd.) at a rotation speed of 1200 rpm under a load of 40 kg and a temperature of 75° C. for 60 minutes, and the wear scar diameter was measured.

Evaluation of Stability: Analysis of Lubricating Base Oil After the Test for Lubricating Ability (g) Measurement of Partial Ester Increase Amount Each lubricating base oil was analyzed by gas chromatography (GC) before and after the test for lubricating ability to measure the partial esters (compound formed by hydrolysis of one of the ester groups of a diester compound) to calculate the amount of increase in GC area % of the partial esters after the test. As for mixed esters, the total of each partial ester was determined.

GC Analysis Conditions

Apparatus: GC-2010 produced by Shimadzu Corporation

Column: TC-5 produced by J&W 30 m×0.25 mm

Column temperature: 60 to 300° C. (rate of temperature increase: 10° C./min)

Injection temperature/detector temperature: 305° C./305° C.

Detector: FID

Carrier gas: helium

Gas flow rate: 1.08 ml/min (h) Measurement of Increase Amount of Total Acid Number The total acid number was measured before and after the test for lubricating ability, and the increase amount of total acid number after the test was calculated.

Starting Materials Used 3-methyl-1,5-pentanediol: MPD, produced by Kuraray Co., Ltd.

n-hexanoic acid: Hexanoic acid, produced by Tokyo Chemical Industry Co., Ltd., was purified by distillation and used ($nC_6$ acid).

n-heptanoic acid: Normal heptanoic acid, produced by Arkema, was purified by distillation and used ($nC_7$ acid).

n-octanoic acid: Caprylic acid, produced by New Japan Chemical Co., Ltd., was purified by distillation and used ($nC_8$ acid).

n-nonanoic acid: n-Pelargonic acid, produced by Oxea, was purified by distillation and used ($nC_9$ acid).

n-decanoic acid: Capric acid, produced by New Japan Chemical Co., Ltd., was purified by distillation and used ($nC_{10}$ acid)

n-undecanoic acid: Undecanoic acid, produced by Tokyo Chemical Industry Co., Ltd., was purified by distillation and used ($nC_{11}$ acid).

Example 1

In a 1-liter, 4-necked flask equipped with a stirrer, a thermometer, and a water separator having a condenser tube were placed 106.5 g (0.92 mol) of n-hexanoic acid, 398.4 g (2.14 mol) of n-undecanoic acid, 177.0 g (1.50 mol) of 3-methyl-1,5-pentanediol, xylene (5 wt % based on the total amount of the starting materials), and tin oxide (0.1 wt % based on the total amount of the starting materials) as a catalyst. After the atmosphere inside the system was replaced with nitrogen, the mixture was gradually heated to 230° C. While removing the generated water that was distilled, with the water separator, and adjusting the degree of reduced pressure to allow reflux to occur, an esterification reaction was conducted until the amount of water collected reached the theoretical amount of generated water (54.0 g) and the total acid number became 20 or less. After the completion of the reaction, xylene and the remaining starting material aliphatic monocarboxylic acids were removed by distillation to obtain a crude esterified product. Thereafter, the obtained crude esterified product was neutralized with 1.2 equivalents of aqueous caustic soda solution relative to the total acid number of the product, and washed with water until the washings became neutral. Further, the obtained crude esterified product was treated with activated carbon, and the activated carbon was then removed by filtration, thereby obtaining 521.8 g of diesters prepared from 3-methyl-1,5-pentanediol, and n-hexanoic acid and n-undecanoic acid (molar ratio: $nC_6$ acid/$nC_{11}$ acid=30/70), the diesters having a total acid number of not greater than 0.01 mg KOH/g and a partial ester amount of 0.12 GC area %. The total acid number, kinematic viscosity, and viscosity index of the synthesized esters were measured, and tests for low-temperature fluidity, heat resistance, and lubricating ability were performed therefor. After the test for lubricating ability, the lubricating base oil was analyzed. Table 1 shows the results of the tests.

Example 2

The procedure of Example 1 was repeated except that 220.3 g (1.53 mol) of n-octanoic acid was used instead of n-hexanoic acid and that the amount of n-undecanoic acid was changed to 284.6 g (1.53 mol), giving 574.7 g of diesters prepared from 3-methyl-1,5-pentanediol, and n-octanoic acid and n-undecanoic acid (molar ratio: $nC_8$ acid/$nC_{11}$ acid=50/50) of the present invention. The total acid number, kinematic viscosity, and viscosity index of the synthesized esters were measured, and tests for low-temperature fluidity, heat resistance, and lubricating ability were performed therefor. After the test for lubricating ability, the lubricating base oil was analyzed. Table 1 shows the results of the tests.

Example 3

The procedure of Example 1 was repeated except that 241.7 g (1.53 mol) of n-nonanoic acid was used instead of n-hexanoic acid and that the amount of n-undecanoic acid was changed to 284.6 g (1.53 mol), giving 594.3 g of diesters prepared from 3-methyl-1,5-pentanediol, and n-nonanoic acid and n-undecanoic acid (molar ratio: $nC_9$ acid/$nC_{11}$ acid=50/50) of the present invention. The total acid number, kinematic viscosity, and viscosity index of the synthesized esters were measured, and tests for low-temperature fluidity, heat resistance, and lubricating ability were performed therefor. After the test for lubricating ability, the lubricating base oil was analyzed. Table 1 shows the results of the tests.

Example 4

The procedure of Example 1 was repeated except that 157.9 g (0.92 mol) of n-decanoic acid was used instead of n-hexanoic acid, giving 620.2 g of diesters prepared from 3-methyl-1,5-pentanediol, and n-decanoic acid and n-undecanoic acid (molar ratio: $nC_{10}$ acid/$nC_{11}$ acid=30/70) of the present invention. The total acid number, kinematic viscosity, and viscosity index of the synthesized esters were measured, and tests for low-temperature fluidity, heat resistance, and lubricating ability were performed therefor. After the test for lubricating ability, the lubricating base oil was analyzed. Table 1 shows the results of the tests.

Example 5

The procedure of Example 1 was repeated except that 263.2 g (1.53 mol) of n-decanoic acid was used instead of n-hexanoic acid and that the amount of n-undecanoic acid was changed to 284.6 g (1.53 mol), giving 613.8 g of diesters prepared from 3-methyl-1,5-pentanediol, and n-decanoic acid and n-undecanoic acid (molar ratio: $nC_{10}$ acid/$nC_{11}$ acid=50/50) of the present invention. The total acid number, kinematic viscosity, and viscosity index of the synthesized esters were measured, and tests for low-temperature fluidity, heat resistance, and lubricating ability were performed therefor. After the test for lubricating ability, the lubricating base oil was analyzed. Table 1 shows the results of the tests.

Example 6

The procedure of Example 1 was repeated except that 368.4 g (2.14 mol) of n-decanoic acid was used instead of n-hexanoic acid and that the amount of n-undecanoic acid was changed to 170.7 g (0.92 mol), giving 606.4 g of diesters prepared from 3-methyl-1,5-pentanediol, and n-decanoic acid and n-undecanoic acid (molar ratio: $nC_{10}$ acid/$nC_{11}$ acid=70/30) of the present invention. The total acid number, kinematic viscosity, and viscosity index of the synthesized esters were measured, and tests for low-temperature fluidity, heat resistance, and lubricating ability were performed therefor. After the test for lubricating ability, the lubricating base oil was analyzed. Table 1 shows the results of the tests.

Example 7

The procedure of Example 1 was repeated except that 145.0 g (0.92 mol) of n-nonanoic acid and 157.9 g (0.92 mol) of n-decanoic acid were used instead of n-hexanoic acid and that the amount of n-undecanoic acid was changed to 227.7 g (1.22 mol), giving 594.3 g of diesters prepared from 3-methyl-1,5-pentanediol, and n-nonanoic acid, n-decanoic acid, and n-undecanoic acid (molar ratio: $nC_9$ acid/$nC_{10}$ acid/$nC_{11}$ acid=30/30/40) of the present invention. The total acid number, kinematic viscosity, and viscosity index of the synthesized esters were measured, and tests for low-temperature fluidity, heat resistance, and lubricating ability were performed therefor. After the test for lubricating ability, the lubricating base oil was analyzed. Table 1 shows the results of the tests.

Comparative Example 1

The procedure of Example 1 was repeated except that 355.0 g (3.06 mol) of n-hexanoic acid and 177.0 g (1.50 mol) of 3-methyl-1,5-pentanediol were used, giving 438.0 g of 3-methyl-1,5-pentanediol-di(n-hexanoate). The total acid number, kinematic viscosity, and viscosity index of the synthesized ester were measured, and tests for low-temperature fluidity, heat resistance, and lubricating ability were performed therefor. After the test for lubricating ability, the lubricating base oil was analyzed. Table 1 shows the results of the tests.

Comparative Example 2

The procedure of Example 1 was repeated except that 397.8 g (3.06 mol) of n-heptanoic acid and 177.0 g (1.50 mol) of 3-methyl-1,5-pentanediol were used, giving 477.1 g of 3-methyl-1,5-pentanediol-di(n-hexanoate). The total acid number, kinematic viscosity, and viscosity index of the synthesized ester were measured, and tests for low-temperature fluidity, heat resistance, and lubricating ability were performed therefor. After the test for lubricating ability, the lubricating base oil was analyzed. Table 1 shows the results of the tests.

Comparative Example 3

The procedure of Example 1 was repeated except that 440.6 g (3.06 mol) of n-octanoic acid and 177.0 g (1.50 mol) of 3-methyl-1,5-pentanediol were used, giving 516.2 g of 3-methyl-1,5-pentanediol-di(n-hexanoate). The total acid number, kinematic viscosity, and viscosity index of the synthesized ester were measured, and tests for low-temperature fluidity, heat resistance, and lubricating ability were performed therefor. After the test for lubricating ability, the lubricating base oil was analyzed. Table 1 shows the results of the tests.

Comparative Example 4

The procedure of Example 1 was repeated except that 483.5 g (3.06 mol) of n-nonanoic acid and 177.0 g (1.50 mol) of 3-methyl-1,5-pentanediol were used, giving 555.2 g of 3-methyl-1,5-pentanediol-di(n-hexanoate). The total acid number, kinematic viscosity, and viscosity index of the synthesized ester were measured, and tests for low-temperature fluidity, heat resistance, and lubricating ability were performed therefor. After the test for lubricating ability, the lubricating base oil was analyzed. Table 1 shows the results of the tests.

Comparative Example 5

The procedure of Example 1 was repeated except that 526.3 g (3.06 mol) of n-decanoic acid and 177.0 g (1.50 mol) of 3-methyl-1,5-pentanediol were used, giving 594.3 g of 3-methyl-1,5-pentanediol-di(n-hexanoate). The total acid number, kinematic viscosity, and viscosity index of the synthesized ester were measured, and tests for low-temperature fluidity, heat resistance, and lubricating ability were performed therefor. After the test for lubricating ability, the lubricating base oil was analyzed. Table 1 shows the results of the tests.

Comparative Example 6

The procedure of Example 1 was repeated except that 569.2 g (3.06 mol) of n-undecanoic acid and 177.0 g (1.50 mol) of 3-methyl-1,5-pentanediol were used, giving 633.3 g of 3-methyl-1,5-pentanediol-di(n-hexanoate). The total acid number, kinematic viscosity, and viscosity index of the synthesized ester were measured, and tests for low-temperature fluidity, heat resistance, and lubricating ability were performed therefor. After the test for lubricating ability, the lubricating base oil was analyzed. Table 1 shows the results of the tests.

TABLE 1

| | Component A | Component B (molar ratio) | Mixing Ratio Component A/ Component B (molar ratio) | Kinematic Viscosity ($mm^2/s$) 0° C. | 40° C. | 100° C. | Viscosity Index | Pour Point (° C.) |
|---|---|---|---|---|---|---|---|---|
| Ex. 1 | $_nC_{11}$ acid | $_nC_6$ acid | 70/30 | 42.4 | 10.10 | 3.05 | 177 | −20 |
| Ex. 2 | | $_nC_8$ acid | 50/50 | 41.9 | 9.98 | 3.00 | 171 | −27.5 |
| Ex. 3 | | $_nC_9$ acid | 50/50 | 48.4 | 10.90 | 3.17 | 169 | −23.5 |
| Ex. 4 | | $_nC_{10}$ acid | 70/30 | 53.8 | 12.04 | 3.46 | 180 | −15.0 |
| Ex. 5 | | $_nC_{10}$ acid | 50/50 | 52.0 | 11.69 | 3.38 | 177 | −17.5 |
| Ex. 6 | | $_nC_{10}$ acid | 30/70 | 49.4 | 11.26 | 3.28 | 177 | −20.0 |
| Ex. 7 | | $_nC_9$ acid/ $_nC_{10}$ acid (30/30) | 40/60 | 47.3 | 10.89 | 3.21 | 175 | −22.5 |
| Comp. Ex. 1 | $_nC_6$ acid | | — | 16.5 | 4.93 | 1.79 | 160 | <−60 |
| Comp. Ex. 2 | $_nC_7$ acid | | — | 21.2 | 5.98 | 2.07 | 164 | <−60 |
| Comp. Ex. 3 | $_nC_8$ acid | | — | 28.2 | 7.35 | 2.40 | 164 | −40 |
| Comp. Ex. 4 | $_nC_9$ acid | | — | 36.3 | 8.87 | 2.75 | 166 | −35 |
| Comp. Ex. 5 | $_nC_{10}$ acid | | — | 46.0 | 10.64 | 3.15 | 174 | −12.5 |
| Comp. Ex. 6 | $_nC_{11}$ acid | | — | 57.6 | 12.67 | 3.59 | 181 | −7.5 |

| | Evaporation Amount (wt %) | Lubricating Ability Test Wear Scar Diameter (mm) | Partial Ester Amount: Initial (GC area %) | After Lubricating Ability Test (GC area %) | Increase Amount (GC area %) | Total Acid Number: Initial (mg KOH/g) | After Lubricating Ability Test (mg KOH/g) | Increase Amount (mg KOH/g) |
|---|---|---|---|---|---|---|---|---|
| Ex. 1 | 3.3 | 0.55 | 0.12 | 0.14 | 0.02 | 0.01≥ | 0.04 | 0.03 |
| Ex. 2 | 1.5 | 0.53 | 0.10 | 0.12 | 0.02 | 0.01≥ | 0.04 | 0.03 |
| Ex. 3 | 1.0 | 0.53 | 0.12 | 0.15 | 0.03 | 0.01≥ | 0.03 | 0.02 |
| Ex. 4 | 1.0 | 0.52 | 0.14 | 0.17 | 0.03 | 0.01≥ | 0.03 | 0.02 |
| Ex. 5 | 0.9 | 0.54 | 0.20 | 0.22 | 0.02 | 0.01≥ | 0.03 | 0.02 |
| Ex. 6 | 0.9 | 0.53 | 0.11 | 0.14 | 0.03 | 0.01≥ | 0.03 | 0.02 |
| Ex. 7 | 0.9 | 0.55 | 0.10 | 0.13 | 0.03 | 0.01≥ | 0.04 | 0.03 |
| Comp. Ex. 1 | 80.1 | 0.58 | 0.56 | 0.80 | 0.24 | 0.01≥ | 0.61 | 0.61 |
| Comp. Ex. 2 | 11.7 | 0.56 | 0.52 | 0.72 | 0.20 | 0.01≥ | 0.58 | 0.57 |
| Comp. Ex. 3 | 5.3 | 0.56 | 0.45 | 0.60 | 0.15 | 0.01≥ | 0.58 | 0.57 |
| Comp. Ex. 4 | 1.6 | 0.55 | 0.40 | 0.58 | 0.18 | 0.01≥ | 0.54 | 0.53 |
| Comp. Ex. 5 | 1.0 | 0.55 | 0.50 | 0.70 | 0.20 | 0.01≥ | 0.52 | 0.51 |
| Comp. Ex. 6 | 0.7 | 0.51 | 0.60 | 0.78 | 0.18 | 0.01≥ | 0.51 | 0.50 |

Table 1 shows that the lubricating base oils of the present invention are extremely excellent in the stability evaluation of lubricating base oils (partial ester increase amount and total acid number increase amount) compared to those of Comparative Examples 1 to 6, and also superior in performance (kinematic viscosity, viscosity index, low-temperature fluidity, heat resistance, lubricating ability) as lubricating base oils.

INDUSTRIAL APPLICABILITY

The lubricating base oil for a fluid bearing of the present invention has a small rate of change in viscosity (a high viscosity index) over a wide temperature range, low viscosity at low temperatures, and good low-temperature fluidity and evaporation resistance, and allows reduced decomposition thereof. Accordingly, the lubricating base oil for a fluid bearing of the present invention enables stable use of fluid bearing motors for a long period of time.

The invention claimed is:

1. A lubricating base oil for a fluid bearing, the lubricating base oil comprising methylpentanediol diesters obtained by an esterification reaction of 3-methyl-1,5-pentanediol with n-undecanoic acid (component A) and aliphatic monocarboxylic acid (component B) selected from the group consisting of (B1) to (B5) below:

(B1) n-hexanoic acid;

(B2) n-octanoic acid;

(B3) n-nonanoic acid;

(B4) n-decanoic acid; or (B5) n-nonanoic acid and n-decanoic acid, the molar ratio of component A to component B being in the range of 30:70 to 70:30, wherein the amount of the methylpentanediol diesters in the lubricating base oil for a fluid bearing is 90 wt % or more.

2. The lubricating base oil for a fluid bearing according to claim 1, wherein component B is selected from the group consisting of (B3) to (B5) below:

(B3) n-nonanoic acid;

(B4) n-decanoic acid; or (B5) n-nonanoic acid and n-decanoic acid.

3. The lubricating base oil for a fluid bearing according to claim 1, which is a lubricating base oil for a fluid dynamic bearing or a lubricating base oil for an oil-impregnated sintered bearing.

4. The lubricating base oil for a fluid bearing according to claim 1, which is a lubricating base oil for a fluid bearing for a spindle motor.

5. The lubricating base oil for a fluid bearing according to claim 2, which is a lubricating base oil for a fluid dynamic bearing or a lubricating base oil for an oil-impregnated sintered bearing.

6. The lubricating base oil for a fluid bearing according to claim 2, which is a lubricating base oil for a fluid bearing for a spindle motor.

7. The lubricating base oil for a fluid bearing according to claim 3, which is a lubricating base oil for a fluid bearing for a spindle motor.

* * * * *